US007906002B2

(12) United States Patent
Shimoda et al.

(10) Patent No.: US 7,906,002 B2
(45) Date of Patent: Mar. 15, 2011

(54) METHOD FOR FORMING SURFACE-TREATING FILM

(75) Inventors: Masaharu Shimoda, Hiratsuka (JP); Eisaku Okada, Toyota (JP)

(73) Assignees: Kansai Paint Co., Ltd., Hyogo-Ken (JP); Toyota Jidosha Kabushiki Kaisha, Aichi-Ken (JP)

( * ) Notice: Subject to any disclaimer, the term of this patent is extended or adjusted under 35 U.S.C. 154(b) by 895 days.

(21) Appl. No.: 11/882,400

(22) Filed: Aug. 1, 2007

(65) Prior Publication Data

US 2008/0254283 A1 Oct. 16, 2008

(30) Foreign Application Priority Data

Aug. 4, 2006 (JP) ..... 2006-213598
Apr. 3, 2007 (JP) ..... 2007-097702

(51) Int. Cl.
*C25D 13/04* (2006.01)
*C25D 13/12* (2006.01)

(52) U.S. Cl. ..... 204/484; 204/506

(58) Field of Classification Search ..... 204/484, 204/506

See application file for complete search history.

(56) References Cited

U.S. PATENT DOCUMENTS

| | | | | |
|---|---|---|---|---|
| 7,625,476 | B2 * | 12/2009 | Shimoda et al. | 204/484 |
| 2003/0221964 | A1 | 12/2003 | Kasahara et al. | |
| 2004/0167266 | A1 | 8/2004 | Hasegawa et al. | |
| 2004/0170840 | A1 | 9/2004 | Matsukawa et al. | |
| 2004/0244874 | A1 | 12/2004 | Nakayama et al. | |

FOREIGN PATENT DOCUMENTS

| | | |
|---|---|---|
| EP | 1 342 758 | 9/2003 |
| EP | 1 405 933 | 4/2004 |
| EP | 1 426 466 | 6/2004 |
| EP | 1 433 878 | 6/2004 |
| EP | 1 788 051 | 5/2007 |
| JP | 2-282499 | 11/1990 |
| JP | 2003-155578 | 5/2003 |
| JP | 2003-166073 | 6/2003 |
| JP | 2003-226982 | 8/2003 |
| JP | 2003-293161 | 10/2003 |
| JP | 2003-328192 | 11/2003 |
| WO | 02/103080 | 12/2002 |
| WO | 2006/109862 | 10/2006 |

OTHER PUBLICATIONS

European Search Report issued Dec. 19, 2007 in EP Application No. 07 01 5197 corresponding to the present U.S. application.

* cited by examiner

*Primary Examiner* — Kishor Maykar

(74) *Attorney, Agent, or Firm* — Wenderoth, Lind & Ponack, L.L.P.

(57) ABSTRACT

This invention relates to a method for forming on a metal substrate a surface treating film excelling in corrosion resistance and stability of film-forming agent, by applying a film-forming agent thereto by a multistage electrification system comprising at least two stages.

10 Claims, No Drawings

METHOD FOR FORMING SURFACE-TREATING FILM

TECHNICAL FIELD

This invention relates to a method for forming surface-treating film excelling in corrosion resistance, using a film-forming agent excelling in stability, to a film structure formed by the method and to the thereby coated articles.

BACKGROUND ART

Conventionally, metal substrates for industrial use are given in the course of surface preparation a zinc phosphate treatment for the purpose of improving corrosion resistance or adherability. However, zinc phosphate treating agent used in the chemical treatment contains large quantities of phosphorus or nitrogen and also contains large quantities of heavy metals such as nickel and manganese for improving the performance of the formed chemical coating, which gives rise to such problems as adverse influences on environments and disposal of industrial waste because the treatment generates a large amount of sludge of zinc phosphate, iron phosphate and the like.

Also for the purpose of improving corrosion resistance of industrial metal substrates, much space and time are required for coating lines for such processing steps as "degreasing-surface treatment-chemical treatment-electrodeposition coating".

JP 2003-155578A proposed a chemical treating agent for iron- and/or zinc-based substrates, which contains substantially no phosphate ion but contains zirconium ion and/or titanium ion and fluorine ion. However, the chemical treating agent for iron- and/or zinc-based substrates as described in JP 2003-155578A has a problem in that satisfactory corrosion resistance or finish cannot be secured unless a coating film is applied thereon by a coating step after the treatment using said agent.

International Publication WO 02/103080 pamphlet discloses a technology for reducing the time and space required for the treating steps by the use of a composition for metal surface treatment, which comprises (A) a compound containing at least one metal element selected from Ti, Zr, Hf and Si and (B) a fluorine-containing compound as a supply source of fluorine ion, whereby precipitating a surface treating film excelling in corrosion resistance on a metal surface containing at least either of iron or zinc, and dispensing with a surface adjustment (leveling) step. This surface treating composition disclosed in International Publication WO 02/05860 pamphlet, however, is also subject to the problem of failing to secure satisfactory corrosion resistance or finish, unless a coating film is applied thereon by a coating step after the treatment therewith.

JP 2003-166073A and JP 2003-226982A disclose a surface treating agent for lubricated steel sheet, which contains (A) amine-modified acrylic resin, (B) at least one compound selected from phosphoric acid-derived compounds, hydrofluoric acid, metal hydrofluoric acid and metal hydrofluoric acid salt, and (C) at least one compound selected from molybdenum compound, tungsten compound and vanadium compound; and which, when coated on zinc-plated steel sheet useful for automobile bodies or household electric appliances, can provide lubricated steel sheet excelling in press-shapability and corrosion resistance. However, the steel sheet which is surface treated with the surface treating agent as disclosed in JP 2003-166073A or JP 2003-226982A fails to show satisfactory corrosion resistance or finish unless a coating film is applied thereon by a coating step after the chemical treatment, and the invention cannot achieve reduction in steps or space-saving.

JP 2003-293161A discloses a polymer composition for metal surface treating agent, which comprises a specific copolymer having salicylideneamino group and amino group. The steel sheet treated with the polymer composition for metal surface treating agent as described in JP 2003-293161A again fails to show satisfactory corrosion resistance or finish, unless a coating film is applied thereon by a coating step, and the invention cannot lead to reduction in steps or space-saving.

Furthermore, JP Hei 2(1990)-282499A discloses a method for forming a coating film on apertures of coating object having complex construction such as an automobile body having apertures of not more than 500 μm in width, by cationic electrodeposition coating according to multistage electricity applying method. The method as described in JP Hei 2(1990)-282499A is effective for improving corrosion resistance of a coating object having apertures of not more than 500 μm in width, by coating the apertures, but does not amount to secure satisfactory corrosion resistance or finish.

JP 2003-328192A (EP1342758A) discloses a method for forming multilayer electrodeposition coating film by applying a cationic electrodeposition paint containing plural emulsions among which the differences in quantity of electricity necessary for starting precipitation are unified. This method, however, is yet incapable of providing sufficient corrosion resistance.

DISCLOSURE OF THE INVENTION

The object of the present invention is to offer a method for forming surface treating film excelling in corrosion resistance of the coated film and in stability of the film-forming agent.

We have engaged in concentrative studies and discovered that the above object could be achieved by applying a specific film-forming agent onto a metal substrate by multistage electricity-applying system, under specific conditions, and come to complete the present invention.

Thus, the present invention provides a method for forming a surface-treating film, which comprises applying a film-forming agent onto a metal substrate by a multistage electricity-applying system comprising at least two stages, the method being characterized in that (i) the film-forming agent comprises 30-20,000 ppm, in terms of the total amount of metal (as converted to mass), of zirconium compound and, where necessary, a compound containing at least one metal (a) which is selected from titanium, cobalt, vanadium, tungsten, molybdenum, copper, zinc, indium, aluminum, bismuth, yttrium, lanthanide metals, alkali metals and alkaline earth metals, and 1-40% by mass of a resin component, (ii) the first stage coating is conducted, with the metal substrate serving as the cathode, by applying electricity at a voltage of 1-50 V ($V_1$) for 10-360 seconds, and the second and subsequent coating is conducted, with the metal substrate serving as the cathode, by applying electricity at a voltage of 50-400 V ($V_2$) for 60-600 seconds, and (iii) the difference between the voltage ($V_2$) and the voltage ($V_1$) is at least 10 V.

This invention also provides a film structure formed by the above method, which comprises a 0.01-5 μm-thick film (F1) containing, based on the total solid content by mass of the film, 25-70 mass % of the zirconium compound and the metal (a)-containing compound in terms of the total amount of the metals (as converted to mass); and 0.1-30 μm-thick film (F2)

on the film (F1), containing, based on the total solid content by mass of the film, less than 25 mass % of the zirconium compound and the metal (a)-containing compound in terms of the total amount of the metals (as converted to mass) and 50-95 mass % of the resin component.

The surface-treating film formed by the method of the present invention excels in corrosion resistance. Also the film-forming agent used in the method of the present invention excels in stability and its corrosion resistance does not deteriorate when used in industrial lines over a prolonged period.

It is not necessarily wholly clear why the film structure formed by the method of the present invention excels in corrosion resistance. Presumably, the film (F1) precipitated on the coated object contributes to suppression of corrosion under the film, and the 0.1-30 μm-thick film (F2) contributes to improve appearance and intercepts corrosion-promoting substances (e.g., $O_2$, $Cl^-$, $Na^+$), each performing the allotted function within the film structure.

Hereinafter the surface treating film-forming method of the present invention is explained in further details.

This invention forms on a metal substrate a surface treating film, using a specific "film-forming agent" under specific conditions, by "a multistage electricity-applying system comprising at least two stages".

Film-Forming Agent:

The film-forming agent to be used in the method of the present invention comprises 30-20,000 ppm in total of metal(s) (as converted to mass) of a metal compound component (A) composed of zirconium compound and, where necessary, a compound containing at least one metal (a) selected from titanium, cobalt, vanadium, tungsten, molybdenum, copper, zinc, indium, aluminum, bismuth, yttrium, lanthanide metals (lanthanum, cerium, praseodymium, neodymium, samarium, europium, gadolinium, terbium, dysprosium, holmium, erbium, thulium, itterbium, ruttetium), alkali metals (lithium, sodium, potassium, rubidium, cesium, francium) and alkaline earth metals (beryllium, magnesium, calcium, strontium, barium, radium); and 1-40 mass % of resin component (B).

Metal Compound Component (A):

In the first stage coating according to the present invention, film (F1) comprising zirconium compound and, where necessary, further a metal (a)-containing compound is formed, as the metal ions originating from the metal compound component (A) precipitate on the metal substrate surface, by multistage electricity-applying system consisting of at least two stages. Where a zirconium compound and a metal (a)-containing compound are to be concurrently used, a single compound containing both zirconium and the metal (a) can be used instead of the concurrent use. Again, where two or more metal (a)-containing compounds are to be used concurrently, it is also possible to use a single compound containing two or more metals (a) instead of the concurrent use.

The zirconium compounds useful in the metal compound component (A) are those zirconium-containing compounds which generate zirconium-containing ions such as zirconium ion, oxyzirconium ion, fluorozirconium ion and the like. As oxyzirconium ion-generating compounds, for example, zirconyl nitrate, zirconyl acetate, zirconyl sulfate and the like; and as fluorozirconium ion-generating compounds, for example, zirconium hydrofluoric acid, zirconium hydrofluoric acid salts (e.g., sodium salt, potassium salt, lithium salt, ammonium salt and the like); can be named. Of these, ammonium fluorozirconate and zirconyl nitrate are particularly preferred.

Metal (a)-containing compounds which are useful in the metal compound component (A) where necessary are those which generate metal (a)-containing ions such as metal (a) ion, fluorometal (a) ion and the like when electricity is passed therethrough at the time of coating. More specifically, as titanium ion-generating compounds, for example, titanium chloride, titanium sulfate; as fluorotitanium ion-generating compounds, for example, titanium hydrofluoric acid, titanium hydrofluoric acid salts (e.g., sodium salt, potassium salt, lithium salt, ammonium salt and the like); can be named;

as cobalt ion-generating compounds, for example, cobalt chloride, cobalt bromide, cobalt iodide, cobalt nitrate, cobalt sulfate, cobalt acetate, ammonium cobalt sulfate and the like can be named.

as vanadium ion-generating compounds, for example, litium orthovanadate, sodium orthovanadate, lithium metavanadate, potassium metavanadate, sodium metavanadate, ammonium metavanadate, sodium pyrovanadate, vanadyl chloride, vanadyl sulfate and the like can be named;

as tungsten ion-generating compounds, for example, litium tungstate, sodium tungstate, potassium tungstate, ammonium tungstate, sodium metatungstate, sodium paratungstate, ammonium pentatungstate, ammonium heptatungstate, sodium phosphotungstate, barium borotungstate and the like can be named;

as molybdenum ion-generating compound, for example, lithium molybdate, sodium molybdate, potassium molybdate, ammonium heptamolybdate, calcium molybdate, magnesium molybdate, strontium molybdate, barium molybdate, phosphomolybdic acid, sodium phosphomolybdate, zinc phosphomolybdate and the like can be named;

as copper ion-generating compounds, for example copper sulfate, copper (II) nitrate trihydrate, copper (II) ammonium sulfate hexahydrate, cupric oxide, copper phosphate and the like can be named;

as zinc ion-generating compounds, for example, zinc acetate, zinc lactate, zinc oxide and the like can be named;

as indium ion-generating compounds, for example, ammonium indium sulfate can be named;

as aluminum ion-generating compounds, for example, aluminum phosphate, tricalcium aluminate, sodium aluminate and the like can be named;

as bismuth ion-generating compounds, for example, inorganic bismuth-containing compounds such as bismuth chloride, bismuth oxychloride, bismuth bromide, bismuth silicate, bismuth hydroxide, bismuth trioxide, bismuth nitrate, bismuth nitrite, bismuth oxycarbonate and the like; and organic bismuth-containing compounds such as bismuth lactate, triphenylbismuth, bismuth gallate, bismuth benzoate, bismuth citrate, bismuth methoxyacetate, bismuth acetate, bismuth formate, bismuth 2,2-dimethylolpropionate and the like can be named; and as yttrium ion-generating compounds, for example, yttrium nitrate, yttrium acetate, yttrium chloride, yttrium sulfamate, yttrium lactate, yttrium formate and the like can be named.

Among lanthanide metal compound, as those which generate lanthanum ions, for example, lanthanum nitrate, lanthanum fluoride, lanthanum acetate, lanthanum boride, lanthanum phosphate, lanthanum carbonate and the like; as cerium ion-generating compounds, for example, cerium (III) nitrate, cerium (III) chloride, cerium (III) acetate, cerium (III) oxalate, ammonium cerium (III) nitrate, diammonium cerium (IV) nitrate and the like; as praseodymium ion-generating compounds, for example, praseodymium nitrate, praseodymium sulfate, praseodymium oxalate and the like; and as neodymium ion-generating compounds, for example, neodymium nitrate, neodymium oxide and the like; can be named.

As alkali metal ion-generating compounds, for example, potassium sulfate, potassium nitrate, lithium sulfate, lithium nitrate, sodium sulfate, sodium nitrate and the like can be named.

As alkaline earth metal ion-generating compounds, for example, calcium carbonate, magnesium nitrate, magnesium oxide, magnesium titanate, magnesium orthosilicate, magnesium pyrophosphate and the like can be named.

These metal (a)-containing compounds can be used either alone or in combination of two or more.

Of these metal (a)-containing compounds, those containing metal (a) selected from titanium, cobalt, vanadium, tungsten, zinc, aluminum, lanthanum, praseodymium and magnesium are preferred. In particular, ammonium hexafluorotitanate, cobalt nitrate, ammonium metavanadate and ammonium tungstate are preferred.

Resin Component (B):

The resin component (B) used in the film-forming agent is preferably a cationic resin composition, from the standpoint of improving corrosion resistance. As the cationic resin composition, for example, one containing a base resin having in its molecules such group(s) as amino, ammonium salt, sulfonium salt, phosphonium salt and the like, which are cationizable in an aqueous medium; and a crosslinking agent can be used. As the resin species of the base resin, for example, epoxy resin, acrylic resin, polybutadiene resin, alkyd resin, polyester resin and the like can be named. From the standpoint of corrosion resistance, amino group-containing epoxy resin (B1) is preferred, and in respect of weatherability, amino group-containing acrylic resin (B2) is preferred.

The amino-containing epoxy resin (B1) include those obtained through reaction of epoxy resin with amino-containing compound. As the epoxy resin which is used as one of the starting materials, one obtained through reaction of polyphenol compound with epihalohydrin, e.g., epichlorohydrin, is particularly preferred, in respect of corrosion resistance of formed film.

As the polyphenol compound useful for forming such epoxy resin, those per se known can be used. As examples of such polyphenol compound, bis(4-hydroxyphenyl)-2,2-propane (bisphenol A), 4,4-dihydroxybenzophenone, bis(4-hydroxyphenyl)methane (bisphenol F), bis(4-hydroxyphenyl)-1,1-ethane, bis(4-hydroxyphenyl)-1,1-isobutane, bis(4-hydroxy-tert-butylphenyl)-2,2-propane, bis(2-hydroxynaphthyl)methane, tetra(4-hydroxyphenyl)-1,1,2,2-ethane, 4,4-dihydroxydiphenylsulfone (bisphenol S), phenol novolak, cresol novolak and the like can be named.

Also as the epoxy resin obtained by reacting such polyphenol compound with epichlorohydrin, bisphenol-type epoxy resin, in particular, those derived from bisphenol A which are expressed by the following formula, are preferred in respect of long-term corrosion resistance, e.g., exposure resistance.

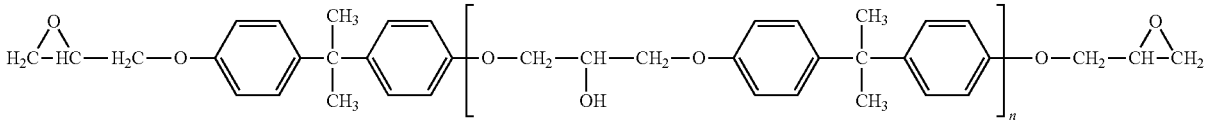

(wherein n=0-8).

As the epoxy resin, those having epoxy equivalent generally within the range of 200-2,000, preferably 400-1,500, and number-average molecular weight (note 1) generally within a range of 400-4,000, preferably 800-2,500 are suitable.

(note 1) Number-average molecular weight:

This can be determined from a chromatogram on RI refractometer using as the separation columns four columns of TSK GEL4000 HXL, TSK G3000 HXL, TSK G2500HXL and TSK G2000 HXL (tradename, Tosoh Corp.) and as the eluent tetrahydrofuran for GPC, at 40° C. and at a flow rate of 1.0 mL/min.; and calibration curve of standard polystyrene, following the method prescribed by JIS K 0124-83.

As such epoxy resin on the market, for example, those sold by Japan Epoxy Resin Co. under the tradenames of EPICOAT828EL, EPICOAT1002, EPICOAT1004 and EPICOAT1007 can be named.

The kind of amino group-containing compounds which can be reacted with above epoxy resins is not critical, so long as it contains at least one active hydrogen reactable with epoxy group and is capable of cationizing the epoxy resin. In particular, however, use of primary amino group-containing compounds which can introduce primary amino groups is preferred.

As primary amino group-containing compounds, for example, ketimination products of amines such as monoethanolamine, propanolamine, hydroxyethylaminoethylenediamine, hydroxyethylaminopropylamine, diethylenetriamine, triethylenetetramine, tetraethylenepentamine, pentaethylenehexamine and the like can be named.

Those primary amino group-containing compounds can be used concurrently with other amino group-containing compounds. As such other compounds, those conventionally used for cationizing epoxy resin can be similarly used, while secondary amines, for example, diethylamine, diisopropylamine, diethanolamine, di(2-hydroxypropyl)amine, monomethylaminoethanol, monoethylaminoethanol and the like are particularly preferred.

Amino group-containing epoxy resin can be obtained by reacting above epoxy resin with amino-containing compound(s) by a method known per se.

Such amino group-containing epoxy resin (B1) can generally have an amine value within a range of 30-70 mgKOH/g of solid resin content, in particular, 40-60 mgKOH/g of solid resin content, for securing water-dispersibility and corrosion resistance of the film.

Furthermore, it is desirable to effect molecular polarization of the amino group-containing epoxy resin (B1) with hydrophobic modifier, for increasing water dispersibility of the resin. As such a modifier, caprolactonepolyol compound, xylene-formaldehyde resin and the like which are reactable with epoxy group can be used.

Such a caprolactonepolyol compound is obtainable by, for example, adding caprolactone to a compound containing plural active hydrogen groups per molecule. Here the "active hydrogen group" means an atomic group containing at least one active hydrogen such as, for example, alcoholic hydroxyl group, primary amino group, secondary amino group and the like.

A compound containing plural active hydrogen groups per molecule can generally have a number-average molecular weight within a range of 62-5,000, preferably 62-4,000, inter alia, 62-1,500. As active hydrogen group-containing compound, those containing on the average at least 2 to less than 30, in particular, 2-20, inter alia, 2-10, active hydrogen groups per molecule, are suitable.

As specific examples of the compounds containing plural active hydrogen groups per molecule, (1) polyol compound, (2) amine compound having primary amino group and/or secondary amino group, or primary amino group and/or secondary amino group and hydroxyl group, (3) linear or branched polyetherpolyol, (4) linear or branched polyesterpolyol, and the like can be named.

Above (1) polyol compound is one containing at least two alcoholic hydroxyl groups per molecule, examples of which include diols such as ethylene glycol, propylene glycol, 1,3-butylene glycol, 1,4-butanediol, 1,6-hexanediol, diethylene glycol, dipropylene glycol, cyclohexane-1,4-dimethylol, neopentyl glycol, triethylene glycol, hydrogenated bisphenol A and the like; triols such as glycerin, trimethylolethane, trimethylolpropane and the like; tetrols such as pentaerythritol, α-methylglucoxide and the like; hexyls such as sorbitol, dipentaerythritol and the like; and octols such as sucrose and the like.

As above (2) amine compound, for example, butylenediamine, hexamethylenediamine, monoethanolamine, diethanolamine, triethanolamine, isophoronediamine, ethylenediamine, propylenediamine, diethylenetriamine, triethylenetetramine and the like can be named.

As above (3) linear or branched polyetherpolyol, those prepared by ring-opening addition reaction of alkylene oxide having a number-average molecular weight normally ranging 62-10,000, preferably 62-2,000 (e.g., ethylene oxide, propylene oxide, butylene oxide, tetrahydrofuran and the like) can be used, specific examples including polyethylene glycol, polypropylene glycol, polytetramethylene glycol, poly(oxyethylene/oxypropylene) glycol, bisphenol A-ethylene glycol ether, bisphenol A-polypropylene glycol ether and the like.

Above (4) linear or branched polyesterpolyol can normally have a number-average molecular weight within a range of 200-10,000, preferably 200-3,000, specific examples being those obtained by polycondensation reaction of organic dicarboxylic acid or anhydride thereof with organic diol, under a condition of organic diol's excess.

As the organic carboxylic acid used therein, $C_{2-24}$, in particular, $C_{4-12}$, aliphatic, alicyclic or aromatic dicarboxylic acids, e.g., succinic acid, adipic acid, azelaic acid, sebacic acid, maleic acid, fumaric acid, glutaric acid, hexachloroheptanedicarboxylic acid, cyclohexanedicarboxylic acid, o-phthalic acid, isophthalic acid, terephthalic acid, tetrahydrophthalic acid, tetrachlorophthalic acid and the like, can be named. In addition to these dicarboxylic acids, it is permissible to concurrently use a minor amount of anhydride of polycarboxylic acid having at least three carboxyl groups or adduct of unsaturated fatty acid. As the organic diol, polypropylene glycol, polyethylene glycol, polylactonediol and the like can be used.

Xylene-formaldehyde resin can be prepared by, for example, condensation reaction of xylene, formaldehyde and optionally phenols, in the presence of an acidic catalyst.

As examples of above formaldehyde, those obtained from industrially readily available compounds which generate formaldehyde, such as formalin, paraformaldehyde, trioxane and the like can be named. In the present specification, where a polymer of paraformaldehyde, trioxane or the like is used, its blended amount is specified based on one molecule of formaldehyde.

The phenols furthermore include monohydric or dihydric phenolic compounds having two or three reaction sites, specific examples being phenol, cresols, para-octylphenol, nonylphenol, bisphenolpropane, bisphenolmethane, resorcine, pyrocatechol, hydroquinone, para-tert-butylphenol, bisphenolsulfone, bisphenol ether, para-phenylphenol and the like. These can be used either alone or in combination of two or more. Of these, phenol and cresols are particularly preferred.

Thus obtained xylene-formaldehyde resin can generally have a viscosity within a range of 20-50,000 mPa·s (25° C.), preferably 25-35,000 mPa·s (25° C.), inter alia, 30-15,000 mPa·s (25° C.), and a hydroxyl equivalent within a range of 100-50,000, preferably 150-30,000, inter alia, 200-10,000.

Reaction method of above polycaprolactonepolyol compound and/or xylene-formaldehyde resin with epoxy resin is not particularly limited, while it is generally preferred to simultaneously react the amine compound and the modifier with epoxy groups of the epoxy resin.

The addition reaction of the amine compound and the modifier to the epoxy resin is normally conducted in an adequate solvent at a temperature of about 80-about 170° C., preferably about 90-about 150° C., for around 1-6 hours, preferably around 1-5 hours, whereby providing polycaprolactonepolyol compound-modified, amino group-containing epoxy resin (B1-1) or xylene-formaldehyde resin-modified, amino-group containing epoxy resin (B1-2).

As the solvent, for example, hydrocarbons such as toluene, xylene, cyclohexane, n-hexane and the like; esters such as methyl acetate, ethyl acetate, butyl acetate and the like; ketones such as acetone, methyl ethyl ketone, methyl isobutyl ketone, methyl amyl ketone and the like; amides such as dimethylformamide, dimethylacetamide and the like; alcohols such as methanol, ethanol, n-propanol, isopropanol and the like; water; or mixtures of these solvents can be used.

The use ratio of above modifier is not strictly limited, but can be suitably varied according to the intended utility of the film-forming agent. Whereas, a generally adequate range is 5-50 mass %, preferably 10-30 mass %, based on the solid mass content of the epoxy resin. When the ratio is less than the lower limit, the necessary amount of resin-neutralizing agent increases, and when it is more than the upper limit, stability of its aqueous dispersion may become inferior.

It is also possible to use as the above-described amino group-containing epoxy resin (B1), phenols-added type polyol-modified amino group-containing epoxy resin (B1-3) which is obtained by reacting epoxy resin with phenols, an amino group-containing compound and a polyol compound obtained by adding caprolactone to a compound containing plural active hydrogen groups.

The epoxy resin to be used for making the phenols-added type, polyol-modified amino group-containing epoxy resin (B1-3) can be similar to those exemplified in respect of the production of polycaprolactonepolyol compound-modified amino group-containing epoxy resin (B1-1) or xylene-formaldehyde resin-modified amino group-containing epoxy resin (B1-2).

As alkylphenols useful for making the phenols-added type polyol-modified amino group-containing epoxy resin, those represented by the following formula (1) can be named:

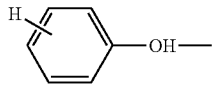

(1)

[wherein

X stands for a $C_{1-15}$ hydrocarbon group optionally having a substituent selected from —OH, —OR, —$NH_2$, —NHR, —SH and —SR, where R stands for alkyl].

In the above formula (1), the $C_{1-15}$ hydrocarbon groups expressed as X may be straight chain, branched chain or cyclic groups. In particular, $C_{1-15}$, inter alia, $C_{1-12}$, alkyl groups such as methyl, ethyl, n-propyl, isopropyl, n-butyl, tert-butyl, nonyl and the like are advantageous. These groups may optionally be substituted with a group selected from hydroxyl (—OH), alkoxy (—OR), mercapto (—SH) and alkylthio (—SR).

As specific examples of phenols of the above formula (1), phenol, cresol, ethylphenol, para-tert-butylphenol, nonylphenol and the like can be named.

The polyol compounds include those obtained by adding caprolactone to compounds having plural active hydrogen groups per molecule. Those polyol compounds as described in respect of preparation of polycaprolactonepolyol compound-modified amino group-containing epoxy resin (B1-1) or xylene-formaldehyde resin-modified amino group-containing epoxy resin (B1-2) can be used.

Also as the amino-containing compound, those similar to the amino group-containing compounds as described in respect of the preparation of polycaprolatonepolyol compound-modified amino group-containing epoxy resin (B1-1) or xylene-formaldehyde resin-modified amino group-containing epoxy resin (B1-2) can be used, specific examples including ketiminated amines such as monoethanolamine, propanolamine, hydroxyethylaminoethylenediamine, hydroxyethylaminopropylamine, diethylenetriamine, triethylenetetramine, tetraethylenepentamine, pentaethylenehexamine and the like; diethylamine diisopropylamine, diethanolamine, di(2-hydroxypropyl)amine, monomethylaminoethanol, monoethylaminoethanol and the like.

As the resin component (B) to be used for the film-forming agent, amino group- and/or phenol compound-containing epoxy resin (B1-4) can also be used, which is formed by reaction of an epoxy resin having at least two epoxy group-containing functional groups of the following formula (2)

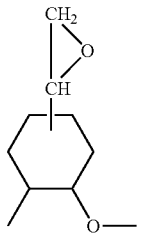

(2)

per molecule, with an amino group-containing compound and/or a phenol compound.

Those epoxy resins having the epoxy group-containing functional groups of the formula (2) are known per se, and those which are described in, for example, JP Sho 60 (1985)-170620A, JP Sho 62 (1987)-135467A, JP Sho 60 (1985)-166675A, JP Sho 60 (1985)-161973A and JP Hei 2 (1990)-265975A can be used.

The epoxy resin also includes those with their termini bonded to residual groups of polymerization initiating component, i.e., active hydrogen-containing organic compound residues. As active hydrogen-containing organic compounds which are the precursors thereof, for example, alcohols such as aliphatic monohydric alcohol, aromatic monohydric alcohol, at least dihydric aliphatic or alicyclic polyhydric alcohol and the like; phenols; fatty acids; aliphatic, alicyclic or aromatic dibasic acids or polybasic acids; oxy acid; polyvinyl alcohol, partial hydrolyzate of polyvinyl acetate, starch, cellulose, cellulose acetate, cellulose acetate butylate, hydroxyethyl cellulose, allylpolyol resin, styrene-allyl alcohol copolymer, alkyd resin, polyesterpolyol resin, polycaprolactonepolyol resin and the like can be named. These active hydrogen-containing organic compounds may also have a skeletal structure in which unsaturated double bond is epoxidated, concurrently with the active hydrogen.

As other epoxy resin, for example, those prepared by a process comprising ring-opening (co)polymerization using above-described active hydrogen-containing organic compound as the initiating agent, in the presence of 4-vinylcyclohexene-1-oxide alone or concurrent presence therewith of another epoxy-containing compound, said polymerization being induced by the epoxy groups contained in the named compounds, to form polyether resin, and then epoxidating the vinyl groups present in its side chains with oxidizing agent such as peracids or hydroperoxides.

4-Vinylcyclohexene-1-oxide can be prepared, for example, by partially epoxidating vinylcyclohexene, which is formed through dimerization reaction of butadiene, with peracetic acid.

As other epoxy-containing compound copolymerizable therewith, any compounds having epoxy groups can be used without particular limitation, while those containing one epoxy group per molecule are preferred from the standpoint of ease of production. More specifically, for example, ethylene oxide, propylene oxide, butylene oxide, α-olefin epoxides represented by the following formula (3)

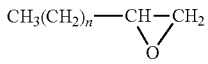

(3)

[in which n is an integer of 2-25], oxide of terminal unsaturated compound such as styrene oxide; allyl glycidyl ether, 2-ethylhexyl glycidyl ether, methyl glycidyl ether, butyl glycidyl ether, phenyl glycidyl ether and the like can be named.

Still other glycidyl group-containing compounds include alicyclic oxirane group-containing vinyl monomers having unsaturated bond, specific examples being those represented by the following formulae:

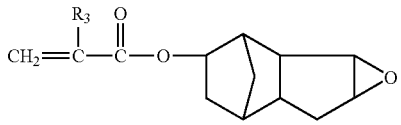

-continued

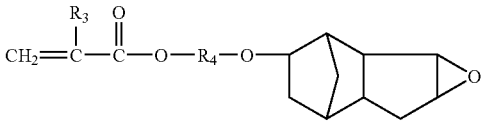

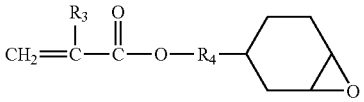

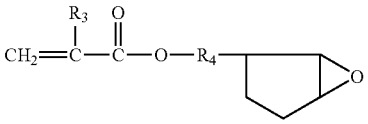

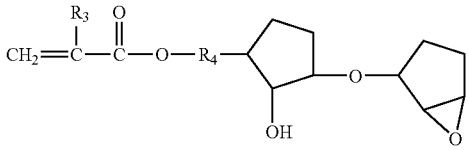

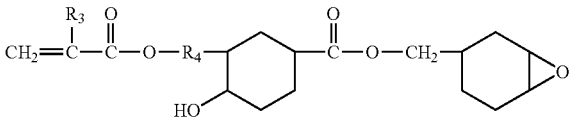

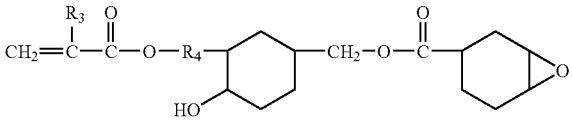

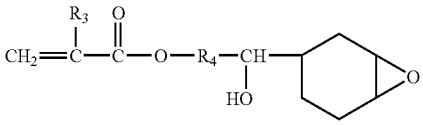

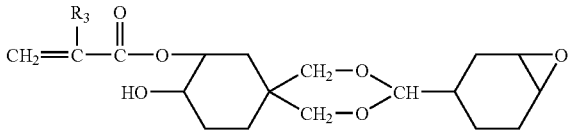

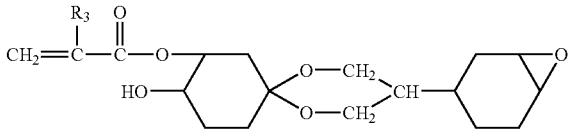

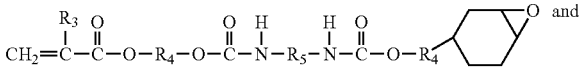

and

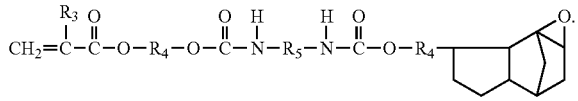

In the above formulae, $R_3$ stands for hydrogen or methyl, $R_4$ stands for $C_{1-6}$ divalent aliphatic saturated hydrocarbon group, and $R_5$ stands for $C_{1-10}$ divalent hydrocarbon group.

In the above formulae, specific examples of $C_{1-6}$ divalent aliphatic saturated hydrocarbon groups represented by $R_4$ include straight chain or branched chain alkylene groups, e.g., methylene, ethylene, propylene, tetramethylene, ethylethylene, pentamethylene and the like. Also $C_{1-10}$ divalent hydrocarbon groups represented by $R_5$ include, for example, ethylene, propylene, tetramethylene, ethylethylene, pentamethylene, hexamethylene, polymethylene, phenylene,

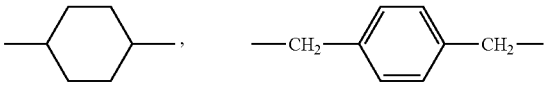

and the like.

Furthermore, the compounds represented by the following formula (4)

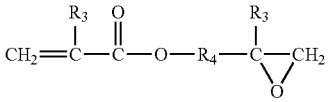

(4)

[in which $R_3$ and $R_4$ have the above-defined significations], for example, glycidyl acrylate, glycidyl methacrylate and the like; and the compounds having alicyclic unsaturated group as expressed by the following formula (5)

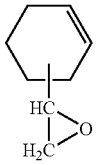

(5)

which may be side-produced of partial epoxidation of vinylcyclohexene, can also be used as other epoxy group-containing compound.

Moreover, 4-vinylcycloheptene (vinyl norbornen) and the like can also be used.

The ring-opening (co)polymerization of epoxy groups, which is conducted in the presence of 4-vinylcyclohexene-1-oxide or in the concurrent presence of the same and other epoxy group-containing compound is preferably carried out in the presence of an active hydrogen-containing organic compound, using a catalyst.

As the catalyst, for example, amines such as methylamine, ethylamine, propylamine, piperazine and the like; organic bases such as pyridines, imidazoles and the like; organic acids such as formic acid, acetic acid, propionic acid and the like; inorganic acids such as sulfuric acid, hydrochloric acid and the like; alkalai metal alcoholates such as sodium methylate and the like; alkalis such as KOH, NaOH and the like; Lewis acids such as $BF_3SnCl_2$, $AlCl_3$, $SnCl_4$ and the like and complexes thereof; and organometal compounds such as triethylaluminium, diethylzinc and the like can be named.

Such catalyst can be used normally within a range of 0.001-10 mass %, preferably 0.1-5 mass %, to the reactants. The ring-opening (co)polymerization reaction can be conducted generally at temperatures ranging −70° C.-200° C., preferably −30° C.-100° C. This reaction is preferably conducted in a solvent, and as the solvent ordinary organic solvent having no active hydrogen can be used.

Thus obtained polyether resin (ring-opened (co)polymer) can then be converted to an epoxy resin having the functional groups of the formula (2), by epoxidating the vinyl groups (—CH═$CH_2$) directly bound to the carbon atoms in the alicyclic structure of side chains thereof.

The epoxidation can be effected using peracids or hydroperoxides. As peracids, for example, performic acid, peracetic acid, perbenzoic acid, trifluoroperacetic acid and the like can be used, and as hydroperoxides, for example, hydrogen peroxide, tert-butyl peroxide, cumene peroxide and the like can be used. The epoxidation reaction can be practiced in the presence of a catalyst, where necessary.

The functional groups of the formula (2) are formed as the vinyl groups in 4-vinylcyclohexene-1-oxide in the ring-opened (co)polymer are epoxidated. In this epoxidation reaction, where an alicyclic oxirane-containing compound as afore-named is concurrently present as other epoxy-containing compound, vinyl groups in said compound may occasionally be also epoxidated, however, to result in a structure different from the functional group of the formula (2).

Use or non-use of a solvent or the temperature of the epoxidation reaction can be suitably adjusted according to the apparatus or properties of the starting materials used. Depending on the epoxidation reaction conditions, a substituent of the following formula (6)

(6)

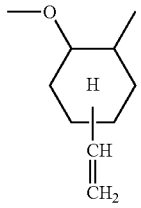

in the starting material(s) and/or the substituent of the formula (2) as formed in the reaction may side-react with epoxidation agent used, simultaneously with the epoxidation of vinyl groups in the starting polymer, to form modified substituents which come to be concurrently present in the epoxy resin.

Commercial products may also be used as such epoxy resin, for example, EHPE 3150 (tradename, Daicel Chemical Industries, Ltd.), in which vinyl groups in ring-opened polymer of 4-vinylcyclohexene-1-oxide are epoxidated.

It is sufficient that at least two epoxy-containing functional groups of the formula (2) are present per molecule of the epoxy resin which can generally have an epoxy equivalent within a range of 140-1,000, preferably 170-300, and a number-average molecular weight generally within a range of 200-50,000, preferably 1,000-10,000.

The amino group-containing compound to be reacted with the epoxy resin is a cationic property-imparting component for introducing amino groups into the base epoxy resin and cationizing said epoxy resin. Amino group-containing compounds similar to those as described in connection with the production of amino group-containing epoxy reins (B1-1), (B1-2), (B1-3), and amino group- and/or phenol compound-containing epoxy resin (B1-4) can be used for that purpose.

It is also possible to use as the amino group-containing compound, those having a hydroxyl group, secondary amino group and amido group per molecule, which are represented by the following formula (7)

(7)

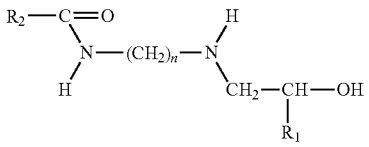

[in which n is an integer of 1-6, $R_1$ stands for hydrogen or $C_{1-2}$ alkyl, and $R_2$ stands for hydroxyl group and/or $C_{4-36}$ hydrocarbon group optionally having polymerizable unsaturated bond].

The compounds of above formula (7) can be prepared by, for example, reacting about 1 mole of N-hydroxyalkylalkylenediamine with about 1 mole of $C_{5-37}$, preferably $C_{8-23}$ monocarboxylic acid, as illustrated by the following reaction scheme:

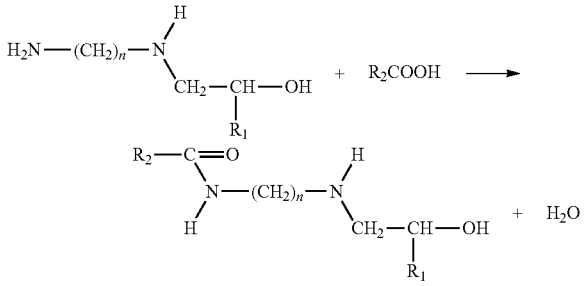

[in the formulae, $R_1$, $R_2$ and n have the previously defined significations].

As the diamine to be used in this reaction, for example, N-hydroxyethylaminoethylamine, N-hydroxyethylethylenediamine, N-hydroxyethylpropylenediamine, N-hydroxyethylbutylenediamine, N-hydroxyethylpentylenediamine, N-hydroxyethylhexylenediamine, N-(2-hydroxypropyl)ethylenediamine, N-(2-hydroxypropyl)propylenediamine, N-(2-hydroxypropyl)butylenediamine, N-(2-hydroxypropyl)pentylenediamine, N-(2-hydroxypropyl)-hexylenediamine and the like can be named. In particular, N-hydroxyethylaminoethylamine, N-hydroxyethylpropylenediamine are preferred.

As the monocarboxylic acid, for example, mixed fatty acids such as coconut oil fatty acid, castor oil fatty acid, rice bran oil fatty acid, soybean oil fatty acid, tall oil fatty acid, dehydrated castor oil fatty acid, safflower oil fatty acid, linseed oil fatty acid, tung oil fatty acid and the like; caprylic acid, capric acid, lauric acid, myristic acid, palmitic acid, stearic acid, oleic acid, ricinoleic acid, linoleic acid, linolenic acid, eleostearic acid, 12-hydroxystearic acid, behenic acid and the like can be named. Of these, stearic acid, oleic acid, 12-hydroxystearic acid and mixed fatty acids containing these acids are particularly preferred.

The reaction of N-hydroxyalkylalkylenediamine with monocarboxylic acid is carried out, for example, by mixing the two components at approximately equimolar ratio, removing the prescribed amount of water produced of the reaction with organic solvent such as toluene or methyl isobutyl ketone, and removing the residual organic solvent by reduced pressure method.

As the phenol compound, those having at least 1, preferably 1-5 phenolic hydroxyl groups per molecule can be used. As specific examples, polyhydric phenol compounds such as 2,2-bis(p-hydroxyphenyl)propane, 4,4'-dihydroxybenzophenone, 1,1-bis(p-hydroxyphenyl)ethane, 1,1-bis(p-hydroxyphenyl)isobutane, 2,2-bis-(4-hydroxy-3-tert-butylphenyl) propane, bis(2-hydroxynaphthyl)methane, 1,5-dihydroxynaphthalene, bis(2,4-dihydroxyphenyl)methane, 1,1,2,2-tetra(p-hydroxyphenyl)ethane, 4,4-dihydroxydiphenyl ether, 4,4-dihydroxydiphenyl sulfone, phenol novolak, cresol novolak and the like can be named.

Monophenol compounds such as phenol, nonylphenol, α- or β-naphthol, p-tert-octylphenol, o- or p-phenylphenol and the like may also be used.

For forming a coating film of still better corrosion resistance, use of reaction products of bisphenols such as bisphenol A [2,2-bis(p-hydroxyphenyl)propane] or bisphenol F [bis(p-hydroxyphenyl)methane] with epichlorohydrin, as the phenol compound, is particularly preferred.

Of such reaction products, particularly those having a number-average molecular weight of at least 200, preferably within a range of about 800-about 3,000 and having on the average not more than 2, preferably 0.8-1.2 phenolic hydroxyl groups per molecule are suitable, which are typically represented by the following formula:

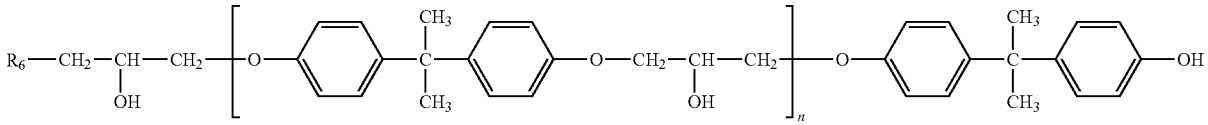

[in the formula, n is 0-7 on the average, and $R_6$ stands for active hydrogen-containing compound residue].

As the active hydrogen-containing compound which is the precursor of $R_6$ in the above formula, for example, amines such as secondary amine; phenols such as nonylphenol; organic acid such as fatty acid; thiols; alcohols such as alkanol, cellosolve, butyl cellosolve or carbitol; and inorganic acids and the like can be named.

Furthermore, a product of reacting, for example, 1 mole of bisphenol A diglycidyl ether type polyepoxide having a molecular weight of at least 200, preferably within a range of 380-2,000, with 1 mole of bisphenol A type polyphenol having a molecular weight of at least 200, preferably within a range of 200-2,000, and 1 mole of active hydrogen-containing compound, in the presence of catalyst or solvent where necessary, at about 30-about 300° C., preferably at about 70-about 180° C., can also be used as the phenol compound. These mole ratios in the reaction are no more than an example and are in no sense limitative. The mole ratios can be optionally selected.

Again, products of reacting bisphenol A with polyols such as dimer diol, ethylene glycol, propylene glycol and butylene glycol; polyether glycols such as polyethylene glycol, polypropylene glycol and polybutylene glycol; polyester polyols such as polycaprolactone; polycarboxylic acids; polyisocyanates; monoisocyanates; oxides of unsaturated compounds such as ethylene oxide, propylene oxide, butylene oxide and styrene oxide; glycidyl ethers of hydroxyl-containing compounds such as allyl glycidyl ether, polypropylene glycol diglycidyl ether, 2-ethylhexyl glycidyl ether, methyl glycidyl ether, butyl glycidyl ether and phenyl glycidyl ether; glycidyl esters of organic acids such as fatty acid; or alicyclic oxirane-containing compounds; can also be used as the phenol compound. Furthermore, graft polymerization products of these compounds with δ-4-caprolactone, acrylic monomer or the like can also be used.

Amino group- and/or phenol compound-containing epoxy resin (B1-4) can be obtained by reaction of above-described epoxy resin with amino group-containing compound and/or phenol compound.

The amino group- and/or phenol compound-containing epoxy resin (B1-4) has a merit of better corrosion resistance as compared with those obtained by reaction with conventional bisphenol A type epoxy resin.

The reaction of epoxy resin with amino group-containing compound or with phenol compound can be conducted, for example, at a temperature within a range of about 50-about 300° C., in particular, about 70-about 200° C. The order of the reactions is not critical but all of the components may be simultaneously charged for the reaction, or each of the components other than the epoxy resin can be added to the epoxy resin by optional order to effect successive reactions.

Such amino group- and/or phenol compound-containing epoxy resin (B1-4) generally has an amine value within a range of 20-150 mgKOH/g, in particular, 30-125 mgKOH/g; hydroxyl value within a range of 300-1,000 mgKOH/g, in particular, 325-850 mgKOH/g; and a number-average molecular weight within a range of 800-15,000, in particular, 900-10,000.

Said epoxy resin (B1-4) particularly excels in water dispersibility, because its hydrophobic portion and hydrophilic portion are co-present and are polarized.

The acrylic resin which is used as a starting material for amino group-containing acrylic resin (B-2) useful as the resin component (B) may be those obtained by radical copolymerization of such acrylic resin-constituting monomeric components as hydroxyl group-containing acrylic monomer, amino group-containing acrylic monomer and other monomer.

Examples of the hydroxyl group-containing acrylic monomer include 2-hydroxyethyl (meth)acrylate, 2-hydroxypropyl (meth)acrylate, 4-hydroxybutyl (meth)acrylate and addition products of 2-hydroxyethyl (meth)acrylate with caprolactone [e.g., PLACCEL FA-2, PLACCEL FM-3 and the like (tradename, Daicel Chemical Industries, Ltd.)], which can be used each alone or in combination of two or more.

Examples of amino group-containing acrylic monomer include, N,N-dimethylaminoethyl (meth)acrylate, N,N-diethylaminoethyl (meth)acrylate, N,N-dimethylaminopropyl (meth)acrylate, N,N-di-t-butylaminoeothyl (meth)acrylate and N,N-dimethylaminopropyl (meth)acrylamide.

Examples of the other monomer include aromatic vinyl monomers such as styrene, vinyltoluene and α-methylstyrene; and alkyl esters of (meth)acrylic acid such as methyl (meth)acrylate, ethyl (meth)acrylate, n-propyl (meth)acrylate, isopropyl (meth)acrylate, n-butyl (meth)acrylate, isobutyl (meth)acrylate, t-butyl (meth)acrylate, cyclohexyl (meth) acrylate and 2-ethylhexyl (meth)acrylate.

Also a resin, which is obtained by adding to glycidyl group in an acrylic resin of radical-polymerizable unsaturated monomers including glycidyl (meth)acrylate, an amino group-containing compound containing also active hydrogen, can also be conveniently used, which contributes to improvement in stability of the coating composition.

The amino group-containing compound reactable with above acrylic resin is not subject to any limitation as to its kind, so long as it is capable of cationizing the acrylic resin. Specific examples include ketimination products of amines such as monoethanolamine, propanolamine, hydroxyethylaminoethylenediamine, hydroxyethylaminopropylamine, diethylenetriamine, triethylenetetramine, tetraethylenepentamine, pentaethylenehexamine; diethylamine, diisopropylamine, diethanolamine, di(2-hydroxypropyl)amine, monomethylaminoethanol, monoethylaminoethanol and the like.

Upon reacting the above acrylic resin with the amino group-containing compound by a method known per se, amino group-containing acrylic resin (B-2) can be obtained.

The amino group-containing acrylic resin (B-2) generally has a hydroxyl value within a range of 10-300 mgKOH/g, preferably 30-250 mgKOH/g, inter alia, 50-200 mgKOH/g solid resin; an amine value of generally within a range of 30-100 mgKOH/g, preferably 35-90 mgKOH/g, inter alia, 40-80 mgKOH/g solid resin; and a number-average molecular weight of generally within a range of 600-3,000, preferably 800-2,700, inter alia, 1,000-2,500.

The resin component (B) may contain as a crosslinking agent blocked polyisocyanate compound (B-3). As the blocked polyisocyanate compound (B-3), aromatic, alicyclic or aliphatic polyisocyanate compounds which are blocked with a blocking agent can be named. They can be used either alone or in combination of two or more.

Specific examples of aromatic polyisocyanate include 1,3- or 1,4-phenylenediisocyanate, 2,4- or 2,6-tolylene diisocyanate (TDI), crude TDI, 2,4'- or 4,4'-diphenylmethane diisocyanate (MDI), 4,4'-diisocyanatobiphenyl, 3,3'-dimethyl-4,4'-diisocyanatobiphenyl, 3,3'-dimethyl-4,4-diisocyanatodiphenylmethane, crude MDI, 1,5-naphthylene diisocyanate, 4,4'-4"-triphenylmethane triisocyanate, m- or p-isocyanatophenylsulfonyl isocyanate and the like.

Specific examples of aliphatic polyisocyanate include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, 2-(isocyanatomethyl-2,6-diisocyanatohexanoate) and the like.

Specific examples of alicyclic polyisocyanate include isophorone diisocyanate (IPDI), dicyclohexylmethane-4,4'-diisocyanate (hydrogenated MDI), p-xylylenediisocyanate (XDI), α,α,α',α'-tetramethylxylylene diisocyanate (TMXDI), cyclohexylene diisocyanate and the like.

Of these polyisocyanate compounds, aliphatic polyisocyanate or alicyclic polyisocyanate are preferred from the standpoint of weatherability.

The blocking agent adds to isocyanate groups in the polyisocyanate compounds to block the compounds. It is desirable that the blocked polyisocyanate compounds formed upon addition of such blocking agent are stable at ambient temperature but dissociate the blocking agent when heated to about 100° C.-about 200° C., general baking temperature range of electrodeposition coating, to regenerate the isocyanate groups.

As blocking agents satisfying such requirement, for example, lactam compounds such as ε-caprolactam and γ-butyrolactam; oxime compounds such as methyl ethyl ketoxime and cyclohexanoxime; phenolic compounds such as phenol, para-t-butylphenol and cresol; aliphatic alcohols such as n-butanol and 2-ethylhexanol; aromatic alkylalcohols such as phenylcarbinol and methylphenylcarbinol; ether alcoholic compounds such as ethylene glycol monobutyl ether and diethylene glycol monoethyl ether; and hydroxyl-containing compounds such as propylene glycol, dipropylene glycol, 1,3-butanediol, 1,2-butanediol, 3-methyl-1,2-butanediol, 1,2-pentanediol, 1,4-pentanediol, 3-methyl-4,3-pentanediol, 3-methyl-4,5-pentanediol, 2,2,4-trimethyl-1,3-pentanediol, 1,5-hexanediol, 1,4-hexanediol, 2,2-dimethylolpropionic acid, 2,2-dimethylolbutanoic acid, dimethylolvaleric acid and glyceric acid.

The resin component (B) comprising the so far described base resin and crosslinking agent can be used for formulation of the film-forming agent, as converted to a resin emulsion by being dispersed in water with a neutralizing agent such as carboxylic acid and deionized water.

The blend ratio of the base resin and crosslinking agent in the resin component (B) is: the base resin is normally within a range of 50-90 mass %, preferably 55-85 mass %, inter alia, 60-80 mass %; and the crosslinking agent is normally within a range of 10-50 mass %, preferably 15-45 mass %, inter alia, 20-40 mass %; based on the mass of the total solid content of the base resin and crosslinking agent.

The film-forming agent contains the metal compound component (A) comprising zirconium compound and, where necessary, compound(s) containing at least one metal (a) selected from titanium, cobalt, vanadium, tungsten, molybdenum, copper, zinc, indium, aluminum, bismuth, yttrium, lanthanide metals, alkali metals and alkaline earth metals, in the total metal amount (as converted to mass) of 30-20,000 ppm, preferably 50-10,000 ppm, inter alia, 100-5,000 ppm; and the resin component (B), in an amount of 1-40 mass %, preferably 5-35 mass %, inter alia, 10-30 mass %; and is capable of forming a film structure excelling in corrosion resistance and finished appearance.

Where the metal compound component (A) contains metal (a)-containing compound(s), its content is variable according to the intended utility of coated article formed by the method of the present invention, while generally it can be no more than 90 mass %, preferably within a range of 5-80 mass %, inter alia, 10-75 mass %, based on the mass of the metal compound component (A).

The film-forming agent can further contain other additives, where necessary, for example, pigment, catalyst, organic solvent, pigment dispersant, surface treating agent, surfactant and the like, each in an amount customary in the art of paint. As the pigment or catalyst, for example, coloring pigment such as titanium white and carbon black; extender such as clay, talc and baryta; rust-preventive pigment such as aluminum dihydrogentripolyphosphate and aluminum phosphomolybdate; organotin compound such as dibutyltin oxide and dioctyltin oxide; and tin compound such as aliphatic or aromatic carboxylate of dialkyltin, e.g., dibutyltin dilaurate, dioctyltin dilaurate, dibutyltin diacetate, dioctyltin dibenzoate and dibutyltin dibenzoate can be named.

The film-forming agent can be formulated, for example, by the following methods (1)-(3):

(1) a method comprising combining the resin component (B) and optionally other additives; thoroughly mixing them to form a dissolved varnish; adding thereto, in an aqueous medium, a neutralizer selected from, for example, formic acid, acetic acid, lactic acid, propionic acid, citric acid, malic acid, sulfamic acid and mixtures of two or more of these acids, to disperse the varnish in the water; and blending the so formed emulsion with the metal compound component (A);

(2) a method comprising adding to the metal compound component (A) pigment, catalyst, other additives and water to disperse them in the water and prepare a pigment-dispersed paste in advance; and adding the paste to an emulsion of the resin component (B); and (3) a method comprising diluting the metal compound component (A) with water and blending the same with an advancedly prepared electrodeposition paint bath.

The film-forming agent can be diluted with deionized water or the like, to adjust the solid concentration in its bath to normally within a range of 5-40 mass %, preferably 8-15 mass %, and its pH, normally within a range of 1.0-9.0, preferably 3.0-6.0, and used.

The film-forming agent prepared as so for described is capable of forming the film structure intended by the present invention on metal substrate, by the hereinafter described at least two-stage multistage electricity application system.

Coating by Multistage Electricity Application System

Coating of the film-forming agent according to the present invention can be effected by multistage electricity application system. Specifically, above-described film-forming agent is used as the bath and the metal substrate, as the cathode, and the first stage coating is conducted by passing electricity at a voltage ($V_1$) of 1-50 V, preferably 2-40 V, for 10-360 seconds, preferably 30-300 seconds, inter alia, 60-240 seconds; then the second and subsequent stage(s)' coating on the metal substrate which serves as the cathode is conducted by passing electricity at a voltage ($V_2$) of 50-400 V, preferably 75-370 V, inter alia, 100-350 V, for 60-600 seconds, preferably 80-400 seconds, inter alia, 90-240 seconds; the difference between the voltage ($V_2$) and that ($V_1$) being at least 10 V, preferably 20-400 V, inter alia, 30-350 V.

It is particularly preferred to carry out the first stage coating at a current density of normally 0.1-1.5 mA/cm, in particular, 0.15-1.2 mA/cm$^2$, inter alia, 0.2-1.0 mA/cm$^2$.

The electrification coating can be effected normally at an interpolar distance of normally 0.1-5 m, preferably 0.2-3 m, inter alia, 0.3-1 m and a polar ratio (anode/cathode) of 1/8-2/1, preferably 1/5-1/2.

The precipitation mechanism of the film is: first, by the first stage electrification, hydrolysis is induced due to pH rise in the vicinity of the cathode, and the zirconium ion species (e.g., complex ion of zirconium and fluorine) in the film-forming agent precipitates on the cathode in the form of a difficultly soluble film (F1) (mainly zirconium oxide).

In the first stage electrification normally the resin component (B) diffuses (disperses) in the film-forming agent's bath or precipitates on the electrode to be re-dissolved, because of the low current density on the cathode, and does not come to form a substantial film on the cathode. Then by the second stage electrification, a film (F2) whose chief components are the resin component (B) and pigment is formed, to produce the film structure of the present invention.

As the bath temperature of the film-forming agent, normally adequate range is 5-45° C., preferably 10-40° C., inter alia, 20-35° C.

The precipitated film can be cured by baking. Normally adequate baking temperature of the film ranges about 100-about 200° C., preferably about 120-about 180° C., at the surface of the object to be coated; and the baking time can range 5-90 minutes, preferably 10-50 minutes.

Upon coating of the film-forming agent by the above multistage electrification system according to the present invention, a film structure can be formed on the metal substrate, the structure comprising a 0.01-5 μm-thick, in particular, 0.05-5 μm-thick film (F1) containing, based on the total solid mass content of the film, 25-70 mass %, in particular, 30-65 mass %, inter alia, 35-60 mass %, of the zirconium compound and the metal (a)-containing compound in terms of the total amount of the metals (as converted to mass); and 0.1-30 μm-thick, in particular, 0.5-25 μm-thick film (F2) on the above film (F1), containing, based on the total solid mass content of the film, less than 25 mass %, in particular, 1-20 mass %, inter alia, 2-15 mass %, of the zirconium compound and the metal (a)-containing compound in terms of the total amount of the metals (as converted to mass) and 50-95 mass %, in particular, 55-92.5 mass %, inter alia, 60-90 mass %, of the resin component.

EXAMPLES

Hereinafter the present invention is explained still more specifically, referring to working Examples, in which "part" and "%" are "mass part" and "mass %".

Production Example 1

Amino Group-Containing Epoxy Resin Solution No. 1

To 400 parts of PP-400 (tradename, Sanyo Chemical Co., Ltd.: polypropylene glycol, molecular weight=400), 300 parts of ϵ-caprolactone was added and heated to 130° C. Then 0.01 part of tetrabutoxytitanium was added and the mixture was further heated to 170° C. While maintaining that temperature, the system was sampled with time until substantial absence of unreacted ϵ-caprolactone was confirmed, when the system was cooled to provide a modifier 1.

Separately, a flask was charged with 1,000 parts of jER828EL (tradename, Japan Epoxy Resin Co., an epoxy resin having epoxy equivalent of 190 and molecular weight of 350), 400 parts of bisphenol A and 0.2 part of dimethylbenzylamine, which were reacted at 130° C. until the epoxy equivalent increased to 750. Then 200 parts of the modifier 1, 140 parts of diethanolamine and 65 parts of ketimination product of diethylenetriamine were added and together reacted at 120° C. for 4 hours. Then adjusting the solid content of the reaction product with ethylene glycol monobutyl ether, polyol-modified amino group-containing epoxy resin solution No. 1 having a solid resin content of 80% was obtained. The amino group-containing epoxy resin No. 1 had an amine value of 56 mgKOH/g and a number-average molecular weight of 2,000.

Production Example 2

Amino Group-Containing Epoxy Resin Solution No. 2

A separable flask of 2 liters in capacity, which was equipped with a thermometer, reflux condenser and stirrer was charged with 480 parts of 50% formalin, 110 parts of phenol, 202 parts of 98% industrial sulfuric acid and 424 parts of metaxylene, which were reacted at 84-88° C. for 4 hours. After termination of the reaction, the system was allowed to stand to separate into the resin phase and aqueous sulfuric acid phase. The resin phase was washed with water three times, and stripped of unreacted metaxylene for 20 minutes under the condition of 20-30 mmHg/120-130° C., to provide 480 parts of a phenol-modified xylene-formaldehyde resin having a viscosity of 1050 centipoise (25° C.).

Separately, 1,000 parts of jER828EL (tradename, Japan Epoxy Resin Co., Ltd., an epoxy resin having an epoxy equivalent of 190 and molecular weight of 350), 400 parts of bisphenol A and 0.2 part of dimethylbenzylamine were reacted in another flask at 130° C., until the epoxy equivalent increased to 750.

Then to the reaction product 300 parts of the xylene-formaldehyde resin, 137 parts of diethanolamine and 95 parts of ketimination product of diethylenetriamine with methyl isobutyl ketone were added and reacted at 120° C. for 4 hours, followed by addition of 403 parts of ethylene glycol monobutyl ether. Whereupon xylene-formaldehyde resin-modified amino group-containing epoxy resin solution No. 2 having a solid resin content of 80% was obtained. The amino group-containing epoxy resin No. 2 had an amine value of 57 mgKOH/g and a number-average molecular weight of 2,000.

Production Example 3

Amino Group-Containing Epoxy Resin Solution No. 3

To 400 parts of PP-400 (tradename, Sanyo Chemical Co., Ltd.: polypropylene glycol, molecular weight=400), 300 parts of ϵ-caprolactone was added and heated to 130° C. Then 0.01 part of tetrabutoxytitanium was added and the mixture was further heated to 170° C. While maintaining that temperature, the system was sampled with time to trace unreacted ϵ-caprolactone with infrared absorption spectroanalysis. At the timepoint when substantial absence of unreacted ϵ-caprolactone was confirmed, the system was cooled to provide a modifier 2.

Separately, to 1,000 parts of jER828EL (tradename, Japan Epoxy Resin Co., Ltd., an epoxy resin having an epoxy equivalent of 190 and molecular weight of 350), 400 parts of bisphenol A and 0.2 part of dimethylbenzylamine were added and reacted at 130° C. until the epoxy equivalent increased to 750.

Then 120 parts of nonylphenol was added and the reaction was continued at 130° C. until the epoxy equivalent increased to 1,000, followed by addition of 200 parts of modifier 2, 95 parts of diethanolamine and 65 parts of a ketimination product of diethylenetriamine. After subsequent reaction at 120° C. for 4 hours, the product was diluted with ethylene glycol monobutyl ether to provide nonylphenol-added, polyol-modified amino group-containing epoxy resin solution No. 3 having a solid resin content of 80%. The amino group-containing epoxy resin No. 3 had an amine value of 40 mgKOH/g and a number-average molecular weight of 2,000.

Production Example 4

Amino Group-Containing Epoxy Resin Solution No. 4

A flask equipped with a stirrer, thermometer, dropping funnel and reflux condenser was charged with 397 parts of ethylene glycol monobutyl ether, 900 parts of EHPE-3150 (epoxy equivalent: 180, Daicel Chemical Industries, Ltd.), 370 parts of an amino group-containing compound[note 2]), 315 parts of diethanolamine and 1651 parts of a phenol compound[note 3]), which were mixed by stirring under heating to 150° C., until the remaining epoxy group became zero. Further 3610 parts of bisphenol A diglycidyl ether having an epoxy equivalent of 190, 1596 parts of bisphenol A, 525 parts of diethanolamine and 1433 parts of ethylene glycol monobutyl ether were added and the reaction was continued at 150° C. until remaining epoxy group became zero. An amine-added epoxy resin solution No. 4 having a solid resin content of 80% was added. The amine-added epoxy resin No. 4 had an amine value of 65 mgKOH/g and a number-average molecular weight of 2,000.

(Note 2) Amino Group-Containing Compound:

A reactor equipped with a thermometer, stirrer, reflux condenser and water-separator was charged with 300 parts of 12-hydroxystearic acid, 104 parts of hydroxyethylaminoethylamine and 80 parts of toluene, which were gradually heated under mixing by stirring. While removing the toluene where necessary, 18 parts of water of the reaction was separated and removed under rising temperature, and thereafter the remaining toluene was removed under reduced pressure. Thus the amino group-containing compound having an amine value of 148 mgKOH/g and solidifying point of 69° C. was obtained.

(Note 3) Phenol Compound:

A flask equipped with a stirrer, thermometer, dropping funnel and reflux condenser was charged with 105 parts of diethanolamine, 760 parts of bisphenol A diglycidyl ether having an epoxy equivalent of 190, 456 parts of bisphenol A and 330 parts of ethylene glycol monobutyl ether, which were reacted at 150° C. until remaining epoxy group became zero. Thus the phenol compound having a solid content of 80% was obtained.

Production Example 5

Production of Hardener No. 1

To 222 parts of isophorone diisocyanate, 44 parts of methyl isobutyl ketone was added, and the temperature was raised to 70° C. Thereafter 174 parts of methyl ethyl ketoxime was dropped into the reaction system over 2 hours. While maintaining this temperature, the system was sampled with time until absence of unreacted isocyanate was confirmed by infrared absorption spectroanalysis. Thus hardener No. 1 of blocked polyisocyanate compound having a solid resin content of 90% was obtained.

Production Example 6

Production of Emulsion No. 1

The amino group-containing epoxy resin No. 1 having a solid resin content of 80% as obtained in Production Example 1, 87.5 parts (solid content, 70 parts), hardener No. 1, 33.3 parts (solid content, 30 parts) and 10% formic acid, 10.7 parts were mixed and stirred to homogeneity. Thereafter dropping 181 parts of deionized water over about 15 minutes under vigorous stirring, emulsion No. 1 having a solid content of 32.0% was obtained.

Production Examples 7-10

Production of Emulsions No. 2-No. 4

Emulsion Nos. 2-4 of each having the blended composition as shown in Table 1 were prepared by the operations similar to Production Example 6.

TABLE 1

| | | Production Example 6 | Production Example 7 | Production Example 8 | Production Example 9 |
|---|---|---|---|---|---|
| | Emulsion | No. 1 | No. 2 | No. 3 | No. 4 |
| Base Resin | Amino group-containing epoxy resin solution No. 1 solid content: 80% | 87.5 (70) | | | |

TABLE 1-continued

| | | Production Example 6 | Production Example 7 | Production Example 8 | Production Example 9 |
|---|---|---|---|---|---|
| | Amino group-containing epoxy resin solution No. 2 solid content: 80% | | 87.5 (70) | | |
| | Amino group-containing epoxy resin solution No. 3 solid content: 80% | | | 87.5 (70) | |
| | Amino group-containing epoxy resin solution No. 4 solid content: 80% | | | | 87.5 (70) |
| Hardener | Hardener No. 1 solid content: 90% | 33.3 (30) | 33.3 (30) | 33.3 (30) | 33.3 (30) |
| Neutralizer | 10% formic acid | 10.7 | 10.7 | 10.7 | 10.7 |
| Deionized water | | 181.0 | 181.0 | 181.0 | 181.0 |
| 32% Emulsion | | 312.5 (100) | 312.5 (100) | 312.5 (100) | 312.5 (100) |

The numerals show the blended amount and those in the parentheses show the solid content.

Production Example 10

Production of Pigment-Dispersed Paste No. 1

The 80% amino group-containing epoxy resin solution No. 4 as obtained in Production Example 4, 6.3 parts (solid content: 5 parts), 10% acetic acid, 1.5 parts, JR-600E(*note 4*), 14 parts (solid content: 14 parts), CARBON MA-7(*note 5*), 0.3 part (solid content: 0.3 part), HYDRITE PXN(*note 6*), 9.7 parts (solid content: 9.7 parts), dioctyltin oxide, 1 part (solid content, 1 part) and deionized water, 21.8 parts were mixed and dispersed, to provide pigment-dispersed paste No. 1 having solid content of 55 mass %.

Production Example 11

Production of Pigment-Dispersed Paste No. 2

Pigment-dispersed paste No. 2 was prepared by the operations similar to Production Example 10, except that the compounds as identified in the following Table 2 were used.

TABLE 2

| | | Production Example 10 | Production Example 11 |
|---|---|---|---|
| Pigment-dispersed paste | | No. 1 | No. 2 |
| Dispersing resin | amino group-containing epoxy resin solution No. 4 | 6.3 (5.0) | 6.3 (5.0) |
| Neutralizer | 10% acetic acid | 1.5 | 1.5 |
| | ammonium fluorozirconate | | 1.3 (1.3) |
| | ammonium hexafluorotitanate | | 2.1 (2.1) |
| Coloring | JR-600E (Note 4) | 14.0 | 14.0 |

TABLE 2-continued

| | | Production Example 10 | Production Example 11 |
|---|---|---|---|
| pigment | | (14) | (14) |
| | CARBON MA-7 (Note 5) | 0.3 (0.3) | 0.3 (0.3) |
| Extender | HYDRITE PXN (Note 6) | 9.7 (9.7) | 9.7 (9.7) |
| Tin catalyst | Dioctyltin oxide | 1.0 (1.0) | 1.0 (1.0) |
| | Deionized water | 21.8 | 24.3 |
| | 55% pigment-dispersed paste | 54.5 (30) | 60.5 (33.3) |

Parenthesized numerals show solid content.
(Note 4)
JR-600E: tradename, Tayca Corporation, titanium white
(Note 5)
CARBON MA-7: tradename, Mitsubishi Chemical Co., carbon black
(Note 6)
HYDRITE PXN: tradename, Georgia Kaolin Co., kaolin

Production Example 12

Emulsion No. 1, 219 parts (solid content: 70 parts), 55% pigment-dispersed paste No. 1 as obtained in Production Example 10, 54.5 parts (solid content: 30 parts) and deionized water, 726.5 parts were mixed to form a bath having a solid content of 10%, and to which 1.32 parts of ammonium fluorozirconate was added to provide film-forming agent No. 1.

Production Examples 13-26

Film-forming agent Nos. 2-15 were prepared in the manner similar to Example 13, except that the blends as shown in the following Tables 3 and 4 were used.

TABLE 3

| | | Production Example 12 | Production Example 13 | Production Example 14 | Production Example 15 | Production Example 16 |
|---|---|---|---|---|---|---|
| Film-forming agent | | No. 1 | No. 2 | No. 3 | No. 4 | No. 5 |
| Bath | Emulsion No. 1 | 219.0 (70) | | | | 219.0 (70) |
| | Emulsion No. 2 | | 219.0 (70) | | | |
| | Emulsion No. 3 | | | 219.0 (70) | | |
| | Emulsion No. 4 | | | | 219.0 (70) | |
| | Pigment-dispersed paste No. 1 | 54.5 (30) | 54.5 (30) | 54.5 (30) | 54.5 (30) | 54.5 (30) |
| | Deionized water | 726.5 | 726.5 | 726.5 | 726.5 | 726.5 |
| | 10% Bath | 1000 (100) | 1000 (100) | 1000 (100) | 1000 (100) | 1000 (100) |

TABLE 3-continued

| | | | | | | |
|---|---|---|---|---|---|---|
| Metal (a)-containing compound | ammonium fluorozirconate | 1.3 (1.3) | 1.3 (1.3) | 1.3 (1.3) | 1.3 (1.3) | 1.3 (1.3) |
| | ammonium fluorotitanate | | | | | 2.1 (2.1) |
| | cobalt nitrate hexahydrate | | | | | |
| | ammonium metavanadate pentahydrate | | | | | |
| | ammonium tungstate pentahydrate | | | | | |
| | praseodymium nitrate hexahydrate | | | | | |

| | | Production Example 17 | Production Example 18 | Production Example 19 | Production Example 20 |
|---|---|---|---|---|---|
| Film-forming agent | | No. 6 | No. 7 | No. 8 | No. 9 |
| Bath | Emulsion No. 1 | 219.0 (70) | 219.0 (70) | 219.0 (70) | 219.0 (70) |
| | Emulsion No. 2 | | | | |
| | Emulsion No. 3 | | | | |
| | Emulsion No. 4 | | | | |
| | Pigment-dispersed paste No. 1 | 54.5 (30) | 54.5 (30) | 54.5 (30) | 54.5 (30) |
| | Deionized water | 726.5 | 726.5 | 726.5 | 726.5 |
| | 10% Bath | 1000 (100) | 1000 (100) | 1000 (100) | 1000 (100) |
| Metal (a)-containing compound | ammonium fluorozirconate | 1.3 (1.3) | 1.3 (1.3) | 1.3 (1.3) | 1.3 (1.3) |
| | ammonium fluorotitanate | | | | |
| | cobalt nitrate hexahydrate | 2.5 (2.5) | | | |
| | ammonium metavanadate pentahydrate | | 1.2 (1.2) | | |
| | ammonium tungstate pentahydrate | | | 0.7 (0.7) | |
| | praseodymium nitrate hexahydrate | | | | 1.5 (1.5) |

Parenthesized numerals show solid content.

TABLE 4

| | | Production Example 21 | Production Example 22 | Production Example 23 |
|---|---|---|---|---|
| Film-forming agent | | No. 10 | No. 11 | No. 12 |
| Bath | Emulsion No. 1 | 219.0 (70) | 219.0 (70) | 219.0 (70) |
| | Emulsion No. 2 | | | |
| | Emulsion No. 3 | | | |
| | Emulsion No. 4 | | | |
| | Pigment-dispersed paste No. 1 | 54.5 (30) | 54.5 (30) | 54.5 (30) |
| | Pigment-dispersed paste No. 2 | | | |
| | Deionized water | 726.5 | 726.5 | 726.5 |
| | 10% bath | 1000.0 (100) | 1000.0 (100) | 1000.0 (100) |
| Metal (a)-containing compound | ammonium fluorozirconate | 1.3 (1.3) | 1.3 (1.3) | 1.3 (1.3) |
| | magnesium nitrate hexahydrate | 5.3 (5.3) | | |
| | lanthanum nitrate hexahydrate | | 1.6 (1.6) | |
| | aluminum nitrate nonahydrate | | | 6.9 (6.9) |
| | zinc nitrate nonahydrate | | | |

| | | Production Example 24 | Production Example 25 | Production Example 26 |
|---|---|---|---|---|
| Film-forming agent | | No. 13 | No. 14 | No. 15 |
| Bath | Emulsion No. 1 | 219.0 (70) | 219.0 (70) | 219.0 (70) |
| | Emulsion No. 2 | | | |
| | Emulsion No. 3 | | | |
| | Emulsion No. 4 | | | |
| | Pigment-dispersed paste No. 1 | 54.5 (30) | | 54.5 (30) |
| | Pigment-dispersed paste No. 2 | | 60.5 (33.3) | |
| | Deionized water | 726.5 | 753.5 | 726.5 |
| | 10% bath | 1000.0 (100) | 1033.0 (103.3) | 1000.0 (100) |
| Metal (a)-containing compound | ammonium fluorozirconate | 1.3 (1.3) | | |
| | magnesium nitrate hexahydrate | | | |
| | lanthanum nitrate hexahydrate | | | |
| | aluminum nitrate nonahydrate | | | |
| | zinc nitrate nonahydrate | 2.3 (2.3) | | |

Parenthesized numerals show solid content.

Example 1

A bath of film-forming agent No. 1 was adjusted to 28° C., and into which cold-rolled sheet steel (70 mm×150 mm×0.8 mm) serving as the cathode was immersed (interpolar distance: 15 cm). Electricity was applied under the conditions of "the first stage: 5V for 60 seconds—the second stage: 260 V for 120 seconds" to make the total dry thickness of the film (F1) and the film (F2) 20 μm. Thus formed film was baked at 170° C. for 20 minutes with an electric dryer to provide a test panel No. 1. The current density in the first stage electrification was 0.2 mA/cm$^2$.

Examples 2-14

Test panel Nos. 2-14 were prepared in the manner similar to Example 1, except that the film-forming agent and electrification conditions as shown in Tables 5 and 6 were used.

TABLE 5

| | | | Example 1 | Example 2 | Example 3 | Example 4 | Example 5 | Example 6 | Example 7 | Example 8 | Example 9 |
|---|---|---|---|---|---|---|---|---|---|---|---|
| Test panel | | | No. 1 | No. 2 | No. 3 | No. 4 | No. 5 | No. 6 | No. 7 | No. 8 | No. 9 |
| Film-forming agent | | | No. 1 | No. 2 | No. 3 | No. 4 | No. 5 | No. 6 | No. 7 | No. 8 | No. 9 |
| The first stage | Voltage (V) | | 5 | 5 | 5 | 5 | 10 | 15 | 15 | 30 | 30 |
| | sec. | | 60 | 60 | 60 | 60 | 50 | 30 | 30 | 30 | 30 |
| | Current density (mA/cm$^2$) | | 0.2 | 0.2 | 0.2 | 0.2 | 0.4 | 0.3 | 0.4 | 1.0 | 1.0 |
| The second stage | Voltage (V) | | 260 | 270 | 270 | 270 | 200 | 200 | 160 | 160 | 200 |
| | sec. | | 120 | 120 | 120 | 120 | 100 | 100 | 90 | 90 | 90 |
| Film structure | Film condition (note 7) | | ○ | ○ | ○ | ○ | ○ | ○ | ○ | ○ | ○ |
| | film (F1) | Total amount of Zr and metal (a) (%) (note 8) | 65 | 60 | 55 | 60 | 55 | 55 | 70 | 70 | 75 |
| | | μm | 1.2 | 1.1 | 1.2 | 2.0 | 2.4 | 2.5 | 3.0 | 2.0 | 2.5 |
| | film (F2) | Total amount of Zr and metal (a) (%) (note 8) | 10.5 | 8.8 | 5.5 | 10.4 | 4.6 | 5.7 | 10.2 | 16.3 | 7.2 |
| | | Resin component (B) content (%) (note 9) | 80 | 70 | 75 | 80 | 90 | 85 | 80 | 80 | 90 |
| | | μm | 18.8 | 18.9 | 18.8 | 18.0 | 17.6 | 17.5 | 17 | 18.0 | 17.5 |
| Corrosion resistance (note 10) | | | ○ | ○ | ○ | ○ | ⊙ | ⊙ | ⊙ | ⊙ | ○ |
| Exposure resistance (note 11) | | | ○ | ○ | ○ | ○ | ⊙ | ⊙ | ⊙ | ⊙ | ⊙ |
| Finished appearance (note 12) | | | ○ | ○ | ○ | ○ | ○ | ○ | ○ | ○ | ○ |
| Stability of film-forming agent (note 13) | | | ⊙ | ⊙ | ⊙ | ⊙ | ⊙ | ⊙ | ⊙ | ⊙ | ○ |

TABLE 6

| | | | Example 10 | Example 11 | Example 12 | Example 13 | Example 14 |
|---|---|---|---|---|---|---|---|
| Test panel | | | No. 10 | No. 11 | No. 12 | No. 13 | No. 14 |
| Film-forming agent | | | No. 10 | No. 11 | No. 12 | No. 13 | No. 14 |
| The first stage | Voltage (V) | | 7 | 7 | 7 | 7 | 7 |
| | sec. | | 80 | 90 | 90 | 90 | 90 |
| | Current density (mA/cm$^2$) | | 0.3 | 0.2 | 0.2 | 0.2 | 0.2 |
| The second stage | Voltage (V) | | 170 | 250 | 200 | 210 | 170 |
| | sec. | | 100 | 90 | 90 | 90 | 90 |
| Film structure | Film condition (note 7) | | ○ | ○ | ○ | ○ | ○ |
| | film (F1) | Total amount of Zr and metal (a) (%) (note 8) | 65 | 70 | 80 | 75 | 70 |
| | | μm | 2.3 | 2.4 | 2.5 | 2.5 | 1.8 |
| | film (F2) | Total amount of Zr and metal (a) (note 8) | 14.3 | 11.3 | 20.2 | 12.3 | 14.1 |
| | | Resin component (B) content (%) (note 9) | 75 | 80 | 75 | 85 | 80 |
| | | μm | 17.7 | 17.6 | 17.5 | 15.5 | 18.2 |
| Corrosion resistance (note 10) | | | ○ | ○ | ○ | ○ | ○ |
| Exposure resistance (note 11) | | | ⊙ | ⊙ | ⊙ | ⊙ | ⊙ |
| Finished appearance (note 12) | | | ○ | ○ | ○ | ○ | ○ |
| Stability of film-forming agent (note 13) | | | ⊙ | ⊙ | ⊙ | ⊙ | ⊙ |

Comparative Examples 1-14

Test panel Nos. 15-28 were prepared in the manner similar to Example 1, except that the film-forming agent and electrification conditions as shown in Tables 7 and 8 were used.

TABLE 7

| | | | Comparative Example 1 | Comparative Example 2 | Comparative Example 3 | Comparative Example 4 | Comparative Example 5 |
|---|---|---|---|---|---|---|---|
| Test panel | | | No. 15 | No. 16 | No. 17 | No. 18 | No. 19 |
| Film-forming agent | | | No. 1 | No. 2 | No. 3 | No. 4 | No. 5 |
| The first stage | Voltage (V) | | | | | | 70 |
| | sec. | | | | | | 130 |
| | Current density ($mA/cm^2$) | | | | | | 0.8 |
| The second stage | Voltage (V) | | 260 | 260 | 260 | 260 | 220 |
| | sec. | | 180 | 180 | 180 | 180 | 50 |
| Film structure | Film condition (note 7) | | X | X | X | X | Δ |
| | film (F1) | Total amount of Zr and metal (a) (%) (note 8) | — | — | — | — | 20 |
| | | μm | — | — | — | — | 6.8 |
| | film (F2) | Total amount of Zr and metal (a) (%) (note 8) | — | — | — | — | 35.2 |
| | | Resin component (B) content (%) (note 9) | — | — | — | — | 45 |
| | | μm | — | — | — | — | 13.2 |
| Corrosion resistance (note 10) | | | X | X | X | X | Δ |
| Exposure resistance (note 11) | | | X | X | X | X | Δ |
| Finished appearance (note 12) | | | ○ | ○ | ○ | ○ | ○ |
| Stability of film-forming agent (note 13) | | | ○ | ○ | ○ | ○ | ○ |

| | | | Comparative Example 6 | Comparative Example 7 | Comparative Example 8 | Comparative Example 9 | Comparative Example 10 |
|---|---|---|---|---|---|---|---|
| Test panel | | | No. 20 | No. 21 | No. 22 | No. 23 | No. 24 |
| Film-forming agent | | | No. 6 | No. 7 | No. 8 | No. 9 | No. 10 |
| The first stage | Voltage (V) | | 110 | 110 | 110 | 0.9 | 110 |
| | sec. | | 70 | 150 | 90 | 180 | 180 |
| | Current density ($mA/cm^2$) | | 1.3 | 1.3 | 130 | 0.05 | 2.4 |
| The second stage | Voltage (V) | | 170 | 250 | 180 | 160 | 160 |
| | sec. | | 110 | 30 | 150 | 90 | 90 |
| Film structure | Film condition (note 7) | | Δ | Δ | Δ | X | X |
| | film (F1) | Total amount of Zr and metal (a) (%) (note 8) | 45 | 75 | 45 | — | — |
| | | μm | 6.0 | 3.5 | 4.5 | — | — |
| | film (F2) | Total amount of Zr and metal (a) (%) (note 8) | 28.3 | 26.4 | 28.9 | — | — |
| | | Resin component (B) content (%) (note 9) | 60 | 65 | 55 | — | — |
| | | μm | 14.0 | 16.5 | 15.5 | — | — |
| Corrosion resistance (note 10) | | | Δ | Δ | X | Δ | Δ |
| Exposure resistance (note 11) | | | Δ | Δ | Δ | Δ | Δ |
| Finished appearance (note 12) | | | ○ | ○ | ○ | ○ | Δ |
| Stability of film-forming agent (note 13) | | | ○ | ○ | ○ | ○ | ○ |

TABLE 8

| | | | Compartive Exampl 11 | Compartive Exampl 12 | Compartive Exampl 13 | Compartive Exampl 14 |
|---|---|---|---|---|---|---|
| Test panel | | | No. 25 | No. 26 | No. 27 | No. 28 |
| Film-forming agent | | | No. 12 | No. 13 | No. 14 | No. 15 |
| The first stage | Voltage (V) | | 130 | 140 | 150 | 10 |
| | sec. | | 90 | 80 | 60 | 60 |
| | Current density (mA/cm$^2$) | | 0.8 | 1.2 | 0.7 | 0.1 |
| The second stage | Voltage (V) | | 180 | 200 | 210 | 280 |
| | sec. | | 150 | 130 | 120 | 120 |
| Film structure | Film condition (note 7) | | Δ | Δ | Δ | X |
| | film (F1) | Total amount of Zr and metal (a) (%) (note 8) | 40 | 35 | 30 | — |
| | | μm | 4.5 | 5.5 | 5 | — |
| | film (F2) | Total amount of Zr and metal (a) (%) (note 8) | 38.5 | 30.1 | 32.1 | — |
| | | Resin component (B) content (%) (note 9) | 55 | 60 | 60 | — |
| | | μm | 15.5 | 14.5 | 15 | — |
| Corrosion resistance (note 10) | | | X | X | X | X |
| Exposure resistance (note 11) | | | Δ | X | X | X |
| Finished appearance (note 12) | | | ○ | ○ | ○ | ○ |
| Stability of film-forming agent (note 13) | | | ○ | ○ | ○ | ○ |

(Note 7)

Film condition:

Each test panel was cut and the coating conditions of the film (F1) and film (F2) were observed with HF-2000 (tradename, Hitachi Seisakujo, a field emission transmission microscope) and JXA-8100 (tradename, JEOL Ltd., an electronic probe microanalyzer). Evaluation of the coating condition was given according to the following standard:

○: layer distinction was clearly recognizable;

Δ: the borderline between the film (F1) and the other (F2) was not clear but layer distinction was more or less recognizable.

X: no layer distinction possible.

(Note 8)

Total amount of Zr and metal (a) (%):

The amount of total metal (mass %) in the films (F1 and F2) was measured with JY-5000 RF (tradename, Horiba Seisakujo, a glow discharge luminescence analyzer) and RIX-3100 (tradename, K.K. Rigaku, a fluorescence X-ray spectroanalyzer).

(Note 9)

Resin component (B) content:

Film (F2) before hardening by baking was scraped off, from which the resin content was calculated according to the following equation (2):

Mass of the film (F2) which was dried at 105° C. for 3 hours . . . b1

Residual mass of the film after 5 hours' baking in a crucible at 800° C. . . . b2

Content (%) of resin component (B) = [(b1 − b2)/b1] × 100 . . . equation (2).

(Note 10)

Corrosion resistance:

Coating film on each test panel was cross-cut with a knife to the depth reaching the substrate surface, and the test panel was given a saline solution spray resistance test for 480 hours following JIS Z-2371. Corrosion resistance was evaluated by the following standard according to width of rust and blister development from the knife cuts:

⊙: the maximum width of rusting and blistering from the cuts was less than 2 mm (single side);

○: the maximum width of rusting and blistering from the cuts was no less than 2 mm but less than 3 mm (single side);

Δ: the maximum width of rusting and blistering from the cuts was no less than 3 mm but less than 4 mm (single side);

X: the maximum width of rusting and blistering from the cuts was 4 mm or more (single side).

(Note 11)

Exposure resistance:

The test panels were applied with WP-300 (tradename, Kansai Paint Co., a water-borne intermediate paint) by spray-coating method, to a hardened film thickness of 25 μm, and baked at 140° C. × 30 minutes in an electric hot air dryer. Further onto the intermediate coating film NEOAMILAC 6000 (tradename, Kansai Paint Co., a top paint) was applied by spray coating method, to a hardened film thickness of 35 μm, which was subsequently baked at 140° C. × 30 minutes in an electric hot air dryer, to provide panels for exposure test.

The coating films on the exposure test panels were cross-cut with a knife to the depth reaching the substrate, and the panels were exposed to the open air in horizontal position for a year in Chikura-cho, Chiba Prefecture, Japan. The exposure resistance was evaluated according to the rusting and blistering width from the knife cuts, by the following standard:

⊙: the maximum width of rusting and blistering from the cuts was less than 2 mm (single side), ○: the maximum width of rusting and blistering from the cuts was no less than 2 mm but less than 3 mm (single side), Δ: the maximum width of rusting and blistering from the cuts was no less than 3 mm but less than 4 mm (single side), and X: the maximum width of rusting and blistering from the cuts was no less than 4 mm (single side)

(Note 12)

Finished appearance:

Surface roughness value ($R_a$) of the coated plane of each test panel was measured with SURF TEST 301 (tradename, MITSUTOYO Co., a surface roughness tester) at a cutoff of 0.8 mm and the evaluation was given according to the following standard:

○: the surface roughness value ($R_a$) was less than 0.2 μm,

Δ: the surface roughness value ($R_a$) was no less than 0.2 μm but less than 0.3 μm, X: the surface roughness value ($R_a$) was no less than 0.3 μm.

(Note 13)

Stability of film-forming agent:

Each of the film-forming agents was stirred in a sealed container at 30° C. for 30 days. Thereafter each the total amount of the film-forming agent was filtered through a 400 mesh-filtration net. The amount of the residue (mg/L) was measured and evaluated according to the following standard:

⊙: less than 5 mg/L,

○: no less than 5 mg/L but less than 10 mg/L,

Δ: no less than 10 mg/L but less than 15 mg/L,

X: no less than 15 mg/L.

The invention claimed is:

1. A method for forming a surface-treating film, which comprises applying a film-forming agent onto a metal substrate by a multistage electricity-applying system comprising at least two stages, the method being characterized in that (i) the film-forming agent comprises 30-20,000 ppm, in terms of the total amount of metal (as converted to mass), of zirconium compound and, where necessary, a compound containing at least one metal (a) which is selected from titanium, cobalt, vanadium, tungsten, molybdenum, copper, zinc, indium, aluminum, bismuth, yttrium, lanthanide metals, alkali metals and alkaline earth metals, and 1-40% by mass of a resin component, (ii) the first stage coating is conducted, with the metal substrate serving as the cathode, by applying electricity at a voltage of 1-50 V ($V_1$) for 10-360 seconds, and the second and subsequent coating is conducted, with the metal substrate serving as the cathode, by applying electricity at a voltage of 50-400 V ($V_2$) for 60-600 seconds, and (iii) the difference between the voltage ($V_2$) and the voltage ($V_1$) is at least 10 V.

2. A method according to claim 1, in which the first stage coating is conducted at a current density of 0.05-1.5 mA/cm$^2$.

3. A method according to claim 1, in which the film-forming agent contains 50-10,000 ppm, in terms of the total amount of metal (as converted to mass), of zirconium compound and metal (a) containing compound.

4. A method according to claim 1, in which the film-forming agent contains 5-35 mass % of the resin component.

5. A method according to claim 1, in which the first stage coating is conducted, with the metal substrate serving as the cathode, by applying electricity at a voltage of 2-40 V ($V_1$) for 30-300 seconds, and the second and subsequent coating is conducted, with the metal substrate serving as the cathode, by applying electricity at a voltage of 75-370 V ($V_2$) for 80-400 seconds.

6. A method according to claim 1, in which the difference between the voltage ($V_2$) and the voltage ($V_1$) is 20-400 V.

7. A method according to claim 1, in which the resin component is a cationic resin composition comprising a base resin and a crosslinking agent.

8. A method according to claim 7, in which the base resin is an amino group-containing epoxy resin or an amino group-containing acrylic resin.

9. A method according to claim 8, in which the amino group-containing epoxy resin is an amino group-containing bisphenol A type epoxy resin.

10. A method according to claim 7, in which the crosslinking agent is blocked polyisocyanate compound.

* * * * *